US005685455A

United States Patent [19]

Glasa

[11] Patent Number: 5,685,455

[45] Date of Patent: Nov. 11, 1997

[54] DEVICE FOR INFLATING A CONTAINER OR A FLOATING BODY, MORE PARTICULARLY A LIFE JACKET

[75] Inventor: Stefan Glasa, Hamburg, Germany

[73] Assignee: Bernhardt Apparatebau GmbH u. Co., Germany

[21] Appl. No.: 386,455

[22] Filed: Feb. 10, 1995

[30] Foreign Application Priority Data

Feb. 11, 1994 [DE] Germany ..... 94 02 270.4
Feb. 11, 1994 [DE] Germany ..... 94 02 271.2

[51] Int. Cl.[6] ..... B63C 9/105

[52] U.S. Cl. ..... 222/5; 441/93; 441/94; 441/96

[58] Field of Search ..... 222/5; 441/92, 441/93, 94, 95, 96

[56] References Cited

U.S. PATENT DOCUMENTS 3,630,413 12/1971 Beckes ..... 222/5
4,968,277 11/1990 Parish et al. ..... 441/93
5,400,922 3/1995 Weinheimer et al. ..... 222/5
5,509,576 4/1996 Weinheimer et al. ..... 222/5

*Primary Examiner*—Gregory L. Huson
*Attorney, Agent, or Firm*—Kelly Bauersfeld Lowry & Kelley, LLP

[57] ABSTRACT

To provide a device (100) for inflating a container or a floating body, more particularly a life jacket, with the aid of a cartridge filled with pressure gas, which device comprises a releasing mechanism being independent of a tablet and being easily ready for operation, allowing a flexible operation and permitting an easy adjustment of the delay time in the case of release, it is suggested that, in said releasing unit (11; 11*a–c*), said first means comprise a sensor (49, 60, 73) which transmits an electric signal and that said second means comprise an electrically controllable locking means which, in the operative state, holds said retaining element in the retaining position and releases the same in the case of release.

36 Claims, 9 Drawing Sheets

DEVICE FOR INFLATING A CONTAINER OR A FLOATING BODY, MORE PARTICULARLY A LIFE JACKET

The invention relates to a device for inflating a container or a floating body, more particularly a life jacket, with the aid of a cartridge filled with pressure gas which possesses a neck being provided with an external thread and sealed with a diaphragm at the upper side. The device comprises a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension. The spring is held in a pretensioned position with the aid of a retaining element and is relieved when actuating the device by moving said retaining element. The device further comprises a releasing unit for releasing the same, said releasing unit comprising first means responding to the presence of water, and second means which in response to said first means release the retaining element held in the retaining position.

BACKGROUND OF THE INVENTION

Automatic devices are known which are comprised of a base body into which the pressure gas bottle is screwed. In addition, there is provided a second separate portion including a spring element which, by the screwing in of the cartridge or by being fitted together, is tensioned and produces the requisite momentum force in order to, with the aid of a pertinent lever drive, subsequent to the interposition of a water-soluble tablet, drive a pointed cutter through the sealing diaphragm for the purpose of opening the pressure gas bottle (DE-AS 27 15 132).

In the known device, the tablet causes an all-mechanical activation where the responsiveness, the time delay but also the sensitivity to environmental influences exclusively depend on the kind of tablet, its composition and other shaping. A modification of the parameters, with the device being ready for operation, is not possible here since such a modification can only be realized by replacing the tablet itself. Moreover, to maintain its effectiveness in its entirety until used, the tablet prior to use needs to be carefully packed, stored and handled.

It; therefore, is the object of the invention to provide a device of the type stated at the beginning which comprises a releasing mechanism not being dependant on the tablet, which releasing mechanism can be made easily ready for operation, features a flexible use and allows a simple adjustment of the delay time in the case of release.

SUMMARY OF THE INVENTION

Provision is made in this case for the first means of the releasing unit to comprise a sensor which transmits an electric signal and for the second means to comprise an electrically controllable locking means which, in the operative state, keeps the retaining element in the retaining position and releases the same in the case of release.

The essence of the invention consists in carrying through the release electrically. The use of electrical means permits a better control and a more flexible improvement of the releasing procedure, e.g. by adjusting a time delay in the case of release. Thereat the sensor may be a resistance sensor and/or a capacitive sensor.

In the known device according to the DE-AS 27 15 132, the release portion provided with the tablet is permanently integrated into the base body. This means that the respective device is unchangeably restricted to a certain kind of release, that is by means of a water-soluble tablet. Provision for any other kinds of release, e.g. electrically or chemically, can only be made if reconstructing the whole device. Furthermore, in the known device it is relatively time-consuming to replace the tablet after release and prepare the device for a new operation.

A further object of the invention, therefore, is to provide a device of the type stated at the beginning which, as may be required, can be quickly and easily equipped with differently functioning releasing mechanisms and, after release, can be easily put in a condition ready for operation again.

Provision is made in this case for the device to be released with the aid of a separate releasing unit adapted to be replaced together with the housing, said releasing unit comprising first means being responsive to the presence of water, and comprising second means which, in response to said first means, releases the retaining element being in the retaining position.

The essence of the invention consists in dividing the device into two parts, that is one part into which the pressure gas bottle is screwed and which comprises the mechanical means for piercing the diaphragm, and a second replaceable portion including the actual releasing mechanism which is responsive to the presence of water and releases the spring for actuating the opening cutter then. In this way, not only differently functioning releasing units can be easily and quickly combined with the same opening mechanism but the releasing portion can also be completely replaced after release which makes it substantially easier to start a new procedure According to a first embodiment of the inventive device, provision is made for the pressure gas bottle to be screwed into the bore of the housing, with the spring being pretensioned at the same time. As a result of the renunciation of a separate tensioning means, the device altogether is simplified furthermore with respect to its structure and operation.

A second embodiment is distinguished in that the spring can be tensioned by means of a shifting member displaceably guided within the housing and acting upon the spring, that, while screwing in the pressure gas bottle from an initial position in the pretensioning direction of the spring, said shifting member is displaceable from the pressure gas bottle, that at the bottom end of said shifting member as a retaining element a single-armed releasing lever at one end is mounted pivotally across shifting direction of the shifting member, that the releasing lever with its lever arm projects into the releasing unit and is held there in the retaining position, that the releasing lever with its lever arm acts upon the spring so that it tensions said spring when the shifting member is moved in while screwing in the pressure gas bottle and keeps the spring in its tensioned position while being held in its retaining position and that the releasing lever acts upon the opening cutter in the direction of piercing.

The lever arm projecting into the releasing unit permits the releasing unit to easily control the opening mechanism and form a mechanically cooperating unit with the housing by simply putting it on the latter.

A third embodiment of the inventive device is characterized in that the first means of the releasing unit comprise a sensor which transmits an electric signal, and that the second means comprise an electrically controllable locking means which holds the retaining element in its retaining position while being ready for operation and releases it in the case of release. The use of electric means allows a better control and more flexible improvement of the releasing procedure, e.g. by setting a time delay in the case of release. Thereat the sensor may be a resistance sensor and/or a capacitive sensor.

A first development of this embodiment is characterized in that, within the housing, at the lower end of the shifting member as a retaining element a single-armed releasing lever at one end is mounted pivotally across shifting direction of the shifting member and with one lever arm projects into the releasing unit, and that the electrically controllable locking means comprises a locking cam rotatably mounted on an axis which locking cam acts upon the lever arm of the releasing lever and, with the aid of an electric motor, can be driven by a gear consisting of a spur gear and a threaded worm. The mechanism of the releasing unit, in this case, involves quite some expenditure but is very reliable.

Moreover, in the case of realease no elements are destroyed which would have to be replaced so that said unit can be used again immediately after the case of release without any further modifications.

A further development of this embodiment is characterized in that, within the housing, at the lower end of the shifting member as a retaining element a single-armed releasing lever at one end is mounted pivotally across shifting direction of the shifting member and with one lever arm projects into the releasing unit, and that the electrically controllable locking means comprise a locking plunger which with a plunger head acts upon the lever arm of the releasing lever and with its other end is supported by an electrically destructible locking element. In this case, the mechanism is reliable and simple.

After release, the electrically destructible locking element which e.g. may be constructed like a classical flash bulb, however, needs to be replaced.

A third development of this embodiment is characterized in that, within the housing, at the lower end of the shifting member as a retaining element a single-armed releasing lever at one end is mounted pivotally across shitting direction of the shifting member and with one lever arm projects into the releasing unit, and that the electrically controllable locking means comprise a locking lever which, in the operative state of the device, with one lever end is supported by a locking pawl adapted to be withdrawn with the aid of an electromagnet to, in this way, hold the retaining element in its retaining position, and, in the case of release, is pivoted about a pivoted axis for releasing the retaining element. This case, with respect to the simple mechanical construction and considering the fact that no releasing elements are to be replaced, represents an intermediate stage between the two previous developments.

A further embodiment of the inventive device is characterized in that the sensor is a resistance sensor, that said resistance sensor together with another resistance forms a voltage divider, that the voltage lost in the voltage divider is applied to the input of a threshold circuit, that the output signal of said threshold circuit drives an oscillator, and that the oscillations of said oscillator are counted by a subsequent counting means in order to activate a release switch for releasing the electrically controllable locking means as soon as a predetermined counter reading is reached. This type of circuit not only is a reliable protection against a false release caused by interfering pulses but also allows the possibility of presetting a time delay in the case of release.

The same advantages are applicable to another embodiment which is distinguished in that the sensor is a capacitive sensor, that said capacitive sensor together with a series resistance forms a voltage divider, that said voltage divider is connected to the output of an oscillator, that the voltage pulses lost in the voltage divider are applied to the input of a threshold circuit, that the threshold circuit is connected to a counter, the clock input of which is connected to the output of the oscillator and the reset input of which is connected to the output of the threshold circuit, and that a release switch is activated for releasing the electrically controllable locking means as soon as a predetermined counter reading is reached. Thereat the capacitive sensor substantially is responsive to the dielectric properties of the water causing the release while the resistance sensor of the previous embodiment substantially is responsive to the conductive properties.

According to a preferred embodiment of the inventive device, provision is made for both a resistance sensor and a capacitive sensor to be connected to two inputs of a control circuit which actuates a release switch as soon as one of the two sensors signalizes the necessity of causing release. As a result of the simultaneous use of both types of sensors, the dependence on the electric properties of the water causing the release is further reduced.

Another preferred embodiment is characterized in that, within said releasing unit, a water-soluble tablet is provided as first means, and that as second means a locking lever is provided which, in the operative state of the device, with one lever end is supported by the tablet so as to hold the retaining element in the retaining position, and is pivoted about a pivoted axis in the case of release for releasing said retaining element. There, within the limits of the invention, can be made use of those tablets which also are used according to the prior art.

A further embodiment of the inventive device is distinguished in that the pressure gas bottle can be screwed into the bore of the housing by, at the same time, tensioning the spring. As a result of the renunciation of a separate tensioning means, the device with regard to its construction and its operation is additionally simplified.

Another embodiment is characterized in that the releasing unit is defined as a separate releasing unit which can be connected to the housing so as to be replaceable with the latter, that the spring can be tensioned by a shifting element displaceably guided within the housing and acting upon the spring, and that, while screwing in the pressure gas bottle from an initial position in the pretensioning direction of the spring, said shifting element is displaceable from the pressure gas bottle, that at the bottom end of said shifting member as a retaining element a single-armed releasing lever at one end is mounted pivotally across shifting direction of the shifting member, that the releasing lever with one lever arm projects into the releasing unit and is held there in the retaining position, that the releasing lever with its lever arm acts upon the spring so that it tensions said spring when the shifting member is moved while screwing in the pressure gas bottle and keeps the spring in its tensioned position while being held in its retaining position, and that the releasing lever acts upon the opening cutter in the direction of piercing.

The lever arm projecting into the releasing unit permits the releasing unit to easily control the opening mechanism and form a mechanically cooperating unit with the housing by simply putting it on the latter.

BRIEF DESCRIPTION OF THE DRAWINGS

In the following the invention is explained in greater detail in connection with the drawings with the aid of embodiment examples. Thus

DETAILED DESCRIPTION OF THE PREFERRED EMBODIMENTS

Figure 1:
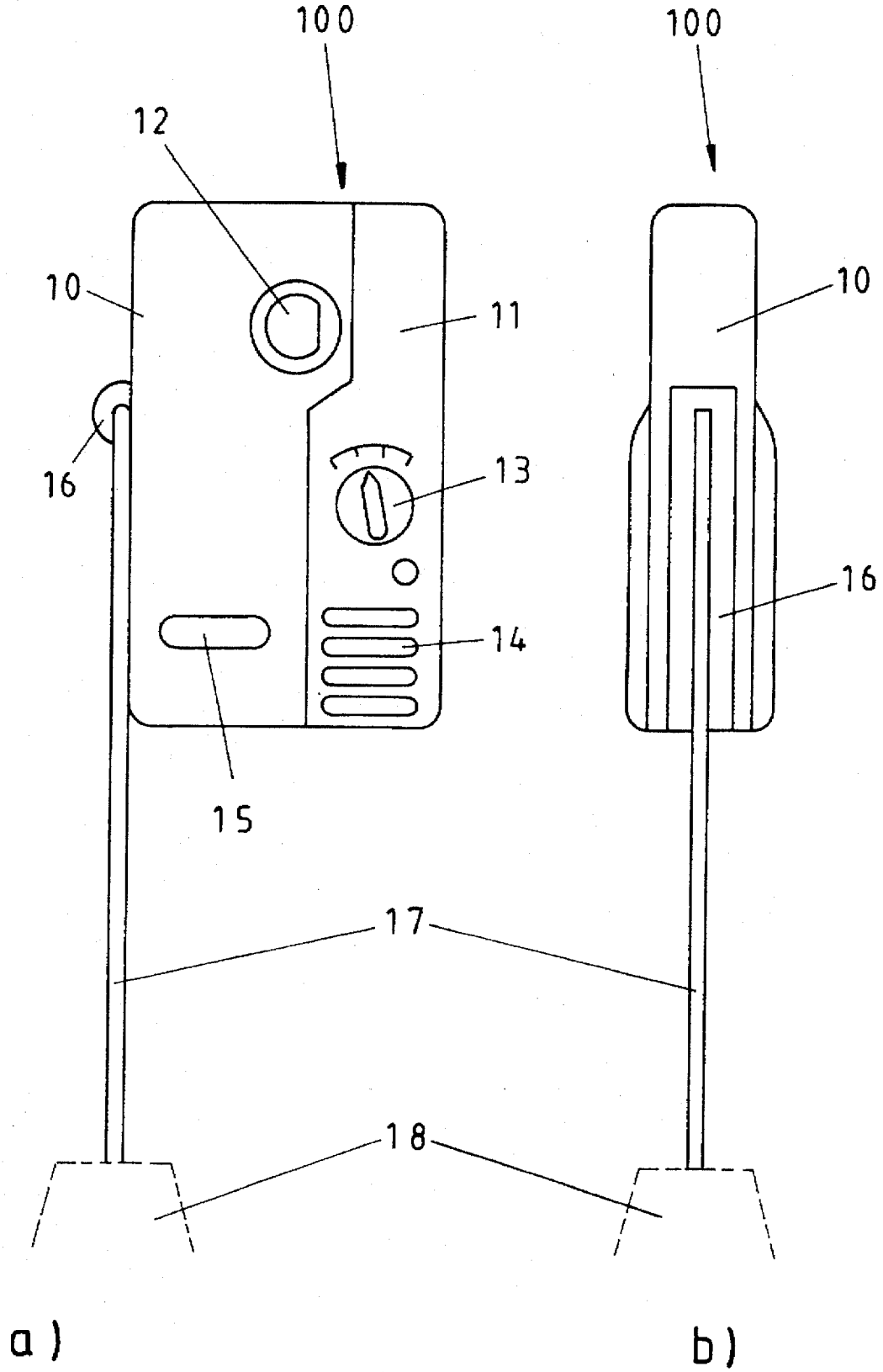
FIG. 1 shows, in a front view (a) and a side view (b), a first embodiment of a device according to the invention with additional manual release.

FIG. 1 is, in a front view (FIG. 1*a*) and a side view (FIG. 1*b*) a first embodiment example of a device according to the invention with additional manual release. The device 100 comprises a housing 10 and a replaceable releasing unit 11 which either is attached to the housing 10 at the side or can be inserted into said housing 10. A pressure gas bottle not shown, the contents of which, in the case of release, are delivered to the container to be filled, e.g. the floating body of a life jacket, through a compressed air intake 12, is screwed into a bore (19 of FIG. 2), not visible, of the housing. In the lower part of the housing 10 a slot-like opening 15 is provided through which one can see from outside whether the device is in an operative or a released state. The releasing unit 11 centrically comprises an adjusting means 13, with the aid of which, for example, the delay time of the releasing means can be adjusted. Furthermore, an electric releasing unit, as will be more detailedly described by means of the diagrams of FIGS. 7–9, may comprise a battery level indicator and a battery control key. At the lower end of the releasing unit 11 air inlet ports 14 are provided which, in the case of release, permit the water to get into the inside of the unit without problems for starting release there.

At the long side of the housing 10 the upper end of one operating arm 16 is shown which operating arm serves the manual release of the device 100 by means of a pull element 17 and a handle 18 and the function of which will be more detailedly described in connection with FIGS. 2 to 5.

Figure 2:
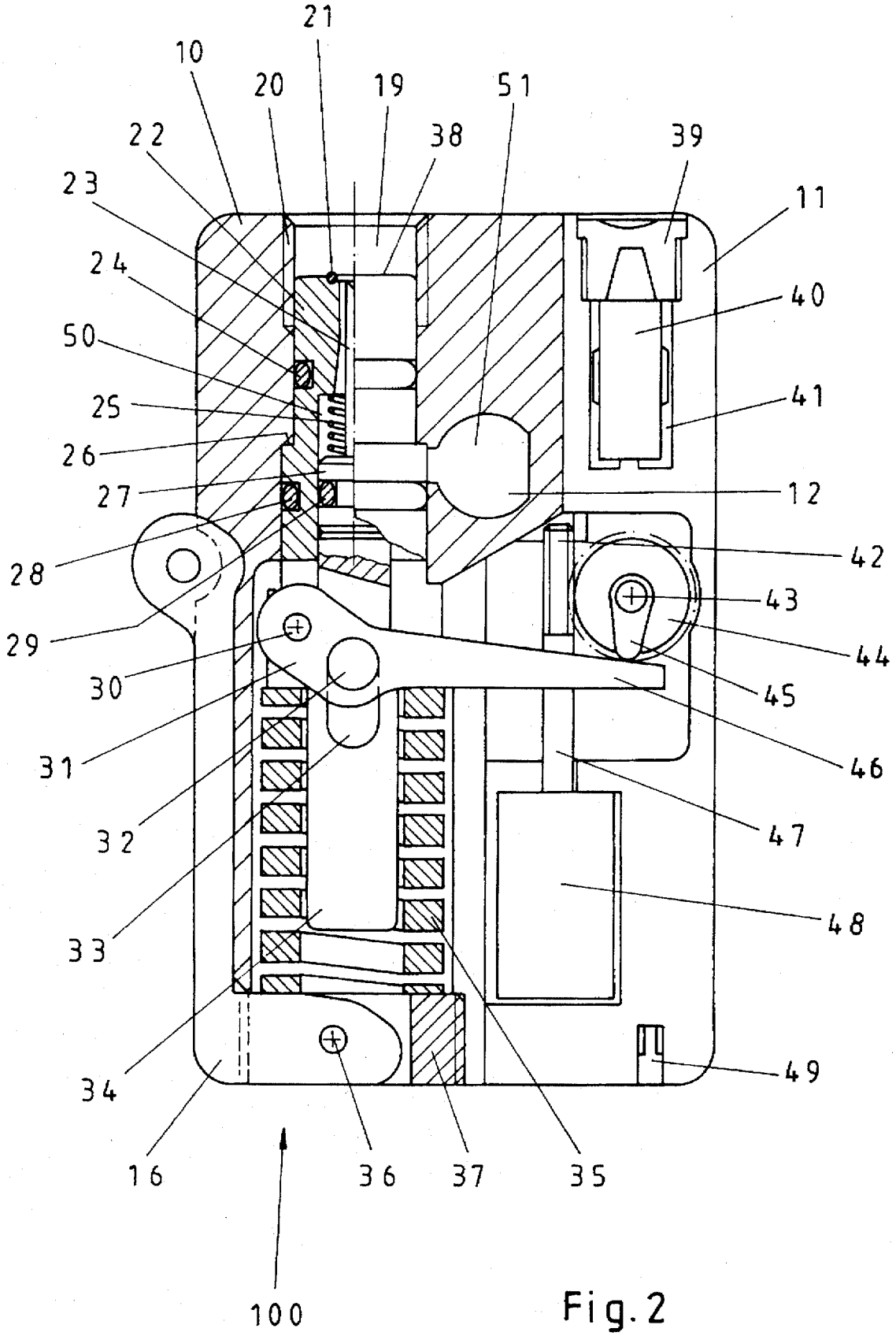
FIG. 2 shows, in a partial section, the inner structure of a second embodiment example of the inventive device permitting an electrically controllable release by means of a motor driven locking cam.

FIG. 2 shows, in a partial section, the inner structure of a preferred embodiment example of the inventive device providing a possible form of the electrically controlled release. The right-side part of the shown device 100—as appears from FIG. 1*a*—is occupied by the housing 10 comprising the mechanical facilities for piercing the diaphragm of the pressure gas bottle. The left-side part, the releasing unit 11, comprises the facilities for controlling the release.

The pressure gas container which is defined as a pressure gas bottle comprises a neck which is provided with an external thread and is sealed with the diaphragm. This external thread serves for screwing the container into the bore 19 provided in the upper portion of the housing 10 and including a corresponding internal thread 20. The bore 19 of the housing is connected with the compressed air intake 12 via a bore 50 for the cutter and a separated channel 51, which compressed air intake 12 serves the purpose of connecting thereto the life preserver to be inflated—not shown. In the bore 19 of the housing a shifting member 22 is arranged which is defined as a shell and with its front end 38 extends up to the area of the upper portion of the bore 19 of the housing including the internal thread 20 so that the neck of the pressure gas container acts upon it when being screwed in. It goes without saying that another constructive development and arrangement can be used as well. The shifting member 22 which in the housing 10 is guided longitudinally displaceable is protected from slipping through the housing 10, a corresponding abutment is indicated at 26. At the lower end of the shifting member 22, an area in which the through-bore 19 extends, a single-armed release lever 31 acting as an operating lever with one end is mounted pivotally so that this lever 31 is adapted to be pivoted about the pivoted axis indicated at 30. The release lever 31 comprises a lever arm 46 which substantially is oriented across the axis of the bore 19 of the housing. The lever arm 46 with its lower side is supported by a spring 35 which in return with its bottom side is supported by a screw-in bottom portion 37 screwed into the bore 19 of the housing. The spring 35 is defined as a helical spring. In its inner bore a central bolt 34 is guided longitudinally displaceable which, within the area of the release lever 31, comprises an elongated hole 33. An operating bolt permanently secured to the release lever 31 reaches through said elongated hole 33 and is guided within the same.

In the cutter bore 50 of said shell-shaped shifting member 22 an opening cutter 27 is arranged displaceably towards the shifting member 22 which opening cutter 27 at its upper end comprises a prong 23 for piercing the diaphragm of the pressure gas container. In its normal position, the opening cutter 27 with its prong 23 extends up to the area of the front end 38 of the shifting member 22. It, with its bottom end, is arranged on the central bolt 34 but can also be defined so as to be one piece with the latter. The opening cutter 27 at the transition to the prong 23 comprises a shoulder by which another spring 25 is supported with its bottom end, which spring 25 with its upper end is pressed against a corresponding shoulder in the bore 50 for the cutter and, as a result, always keeps the opening cutter 27 in its lower unoperated position in the state of rest.

At the front end 38 of the shifting member 22 a first sealing ring 21 is provided which outwardly seals the connection between the neck of the pressure gas container screwed in and the bore 50 for the cutter. Further sealing rings 24, 28 and 29 are provided on the peripheral surface of the shifting member 22 as well as the opening cutter 27.

The function of the device according to FIG. 2 is the following one:

Screwing the pressure gas container into the release mechanism provided in the housing 10 causes the shifting member 22 and, at the same time, the release lever 31 to preferably move downwardly by a few millimeters. Thereat the spring 35 is tensioned. During this procedure, the prong 23 of the opening cutter piercing the diaphragm in the case of release is retained by the spring 25 so that the prong 23 is not capable of unintentionally boring its way through the diaphragm of the pressure gas container. The same spring 25 causes the prong 23 to return to its starting position after release so that, after piercing the diaphragm, the gas or compressed air being under pressure can escape from the pressure gas container to get into the separated channel 51 through the cutter bore 50.

The force of the spring 35 compressed during tensioning is transferred to the lever arm 46 of the release lever 31 and, from there, to the central bolt 34 by means of the operating bolt 32 guided in the elongated hole 33. By means of a locking cam 45 rotatably mounted about an axis 43 of the releasing unit 11 the release lever 31 is prevented from making a swivelling upward movement about the pivoted axis 30. After, in the case of release, said locking cam 45 had been removed from its downward locking position by means of an electric releasing means provided within the releasing unit 11, which releasing means will be more detailedly described hereinafter, the release lever 31 is capable of pivoting upwardly under the pressure of the spring 35 by, at the same time, moving the central bolt 34 upwardly with the aid of the operating bolt 32. The central bolt 34 then causes the opening cutter 27 and, consequently, also the prong 23 to move a few millimeters upwardly to, in this way, reliably pierce the diaphragm of the pressure gas container. The compressed air from the pressure gas container then escapes to the compressed air intake 12 through the open diaphragm, the bore 50 for the cutter and the separated channel 51.

In addition to the automatic release by the releasing unit 11, an operating arm 16 mounted pivotally about an axis 36 is arranged at one long side of the housing 10 for manual release, which operating arm 16 with its bottom end moves the central bolt 34 upwardly while being pivoted about axis 36 downwardly. The elongated hole 33 in the central bolt 34 is required for the manual release since, otherwise, the central bolt 34 cannot be displaced irrespective of the release lever 31.

The releasing unit is equipped with an electrically controlled mechanism for moving the locking cam 45. Said locking cam 45 together with a spur gear 44 is arranged on a common axis 43. A corresponding threaded worm 42 arranged on the motor axis 47 of an underlying electric motor 48 engages the toothing of the spur gear 44. In the case of release, the electric motor 48 gets its electric energy from a battery 40 which can be inserted into a battery compartment 41 provided in the upper part of the releasing unit 11. Said battery compartment 41 can be closed with the aid of a screwed cap 39 which protects the battery 40 and, at the same time, makes contact to the battery 40. At the bottom side of the releasing unit 11 a sensor 49 is arranged which, after getting into contact with water, transmits an electric release signal which, by means of an adequate electric circuit, such as the one shown in FIG. 7 or 8, causes an activation of the electric motor 48.

Figure 3:
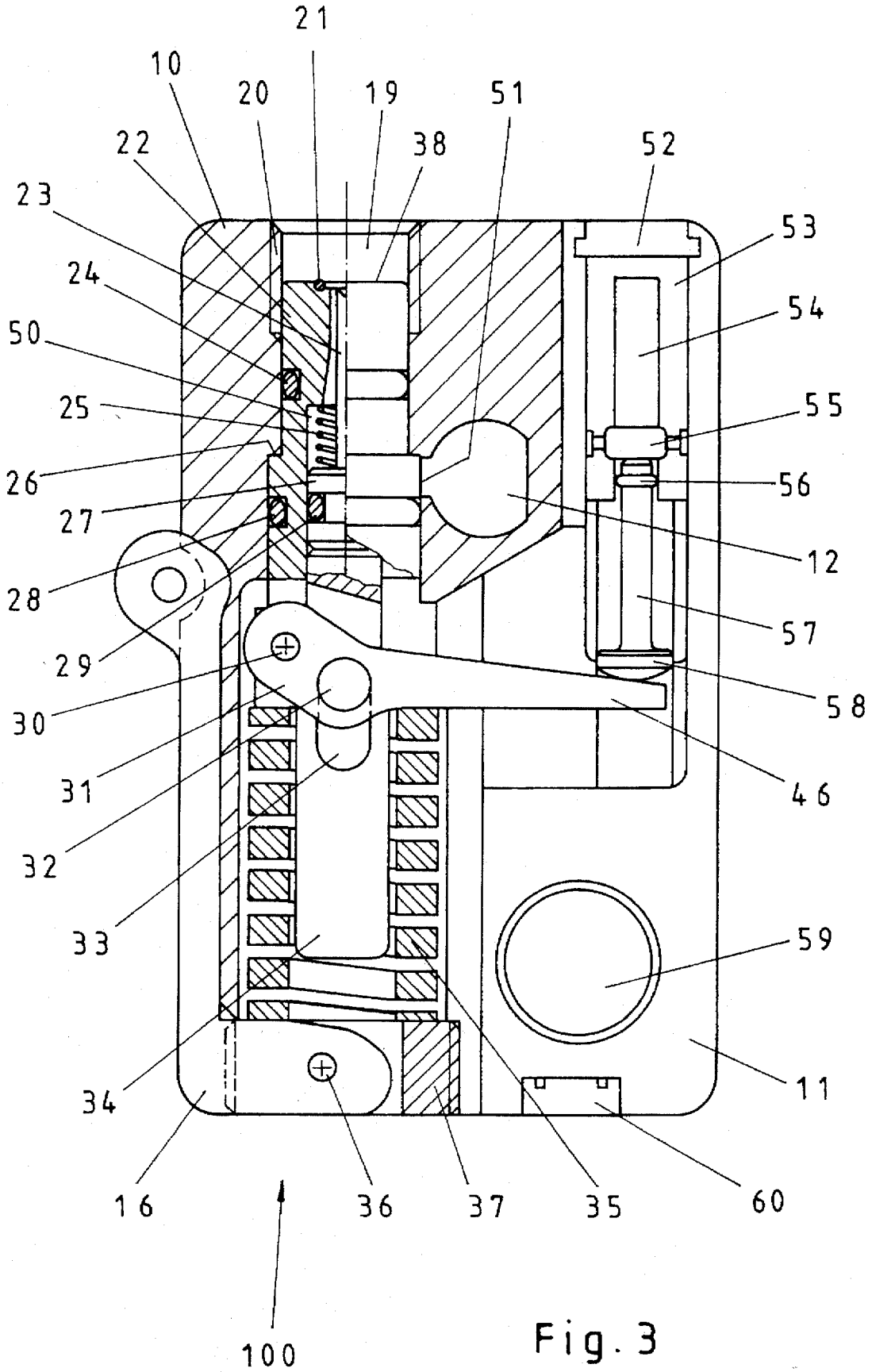
FIG. 3 shows, in a partial section, the inner structure of a third embodiment example of the inventive device permitting an electrically controllable release with the aid of a locking plunger which is supported by an electrically destructible locking element.

FIG. 3 shows a further preferred embodiment example of the inventive device. This embodiment example, with respect to the opening mechanism provided in the housing 10, in its structure is completely identical to the example of FIG. 2. The releasing unit 11, however, is different therefrom in structure and function. There the lever arm 46 of the release lever 31, in the operative tensioned state, is prevented by the locking plunger 57 of a releasing means 53 from making a pivoting upward movement, which locking plunger 57 with its plunger head 58 provided below engages to the upper side of the lever arm 46 and with its upper end is supported by a transversely arranged, electrically destructible locking element 55. With the aid of a guiding ring 56 said locking plunger 57 is guided within a plunger bore 54 but, by means of the undestroyed locking element 55, is prevented from urging into the bore 54. Said locking element 55 at both ends comprises electric contacts, which, in the case of release, serve for firing it. As soon as the locking element 55 is destroyed as a result of the firing, said locking plunger 57 with its upper end urges into the plunger bore 54 to cause the release lever 31 to pivot upwardly into the release position. The destroyed locking element 55 can be replaced by removing a sealing cap 52 on the upper side to allow the releasing means 53 to be removed at least partly.

With respect to the electronic release, the principle of a flash bulb should be applied. This flash bulb should be covered with plastic material to prevent the glass splinters from falling into the housing during firing. The bulb, however, needs to be destroyed so as to cause release of the locking plunger 57. The locking element 55 can also be defined in the form of a tablet outside and consist of two thin sheets of glass comprising a layer of magnesium powder therebetween. In the case of release, the magnesium powder is passed by an electric current which causes the magnesium powder to oxidize all of a sudden which results in a destruction of the sheets of glass and, consequently, in a movement of the locking plunger 57 locked before.

The firing power is got from a battery 59 in the form of a round cell. The release is controlled by a sensor 60 (capacitive or resistance sensor) arranged on the bottom side.

Figure 4:
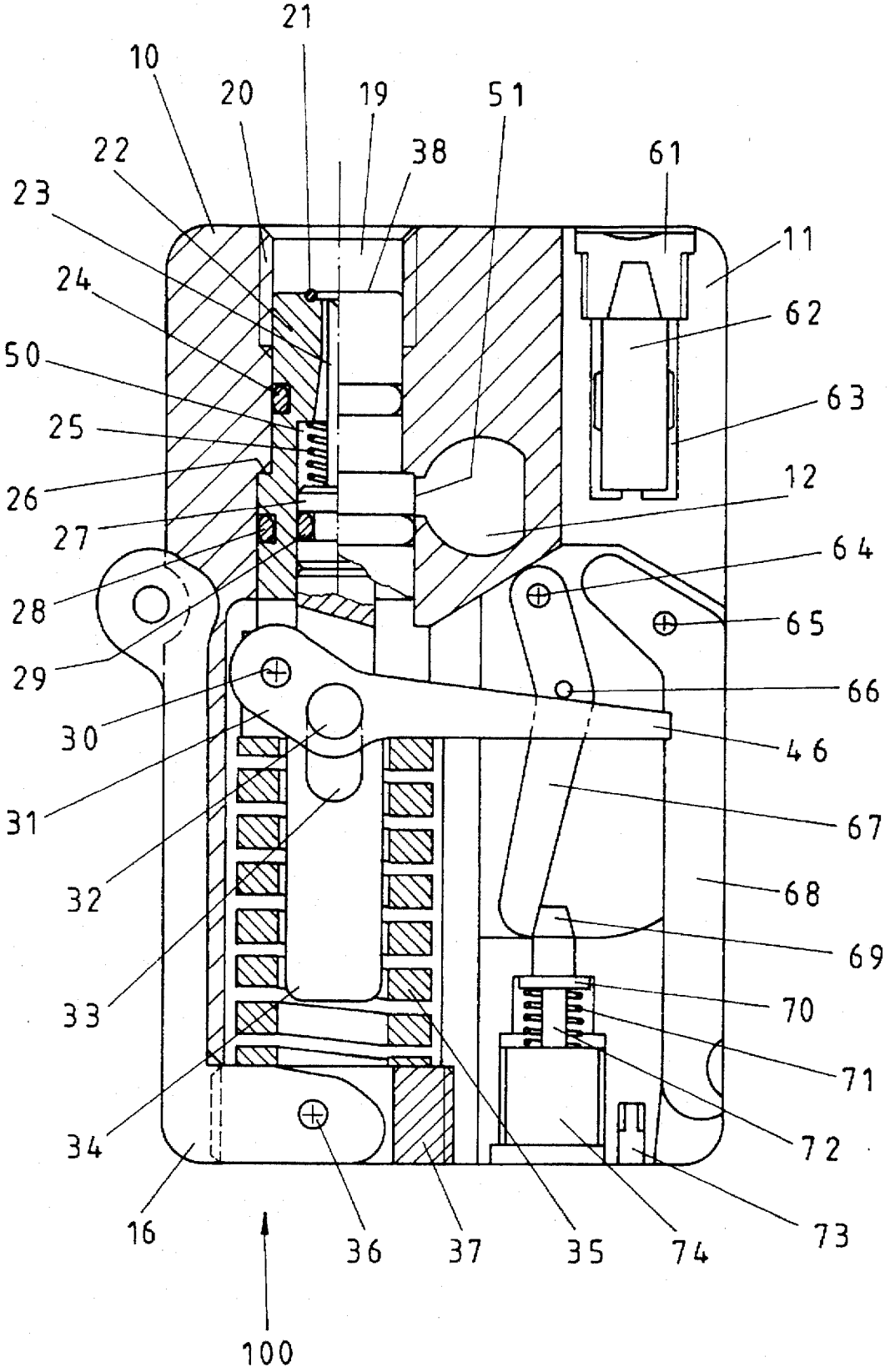
FIG. 4 shows, in a partial section, the inner structure of a fourth embodiment example of the inventive device permitting an electrically controllable release with the aid of a locking pawl that can be drawn back electro-magnetically.

Another preferred embodiment example which differs from the previous ones (FIGS. 2 and 3) only in the structure of the releasing unit 11 and is electrically released as well is shown in FIG. 4. In this case, the lever arm 46 of the release lever 31 is held in the locking position by means of a locking lever 67 which substantially is normal to the lever arm 46 and is mounted pivotally sidewards about a pivoted axis 64. The lever arm 46 is locked by means of a locking bolt 66 which is provided on the locking lever 67 and acts upon the upper side of the lever arm 46. Thereat the locking bolt 66 is arranged below the pivoted axis 64 so as to allow the spring-loaded release arm 31 to pivot said locking lever 67 to the right without any additional measures. In the operative state of the device, such a pivoting movement is prevented by a locking pawl 69 provided at the bottom end of the locking lever 67 which locking pawl 69, in the passive state, is kept in the locking position by means of a bias spring 71 and, in the case of release, can be released from its locking position by means of an electromagnet 74 acting against the spring pressure. The locking position is determined by an abutment ring 70 which is permanently connected with the locking pawl 69. Also in this case the release pulse is transmitted by a sensor 73 which is arranged at the bottom side of the releasing unit 11.

For the battery 62 a battery compartment 63—analogous to FIG. 2—is provided which can be closed by means of a screw-in cap 61. To enable the locking lever 67 to return to its locking position after release the releasing unit 11 at the side is closed by a covering portion 68 adapted to be pivoted about a pivoted axis 65 outwardly.

Figure 5:
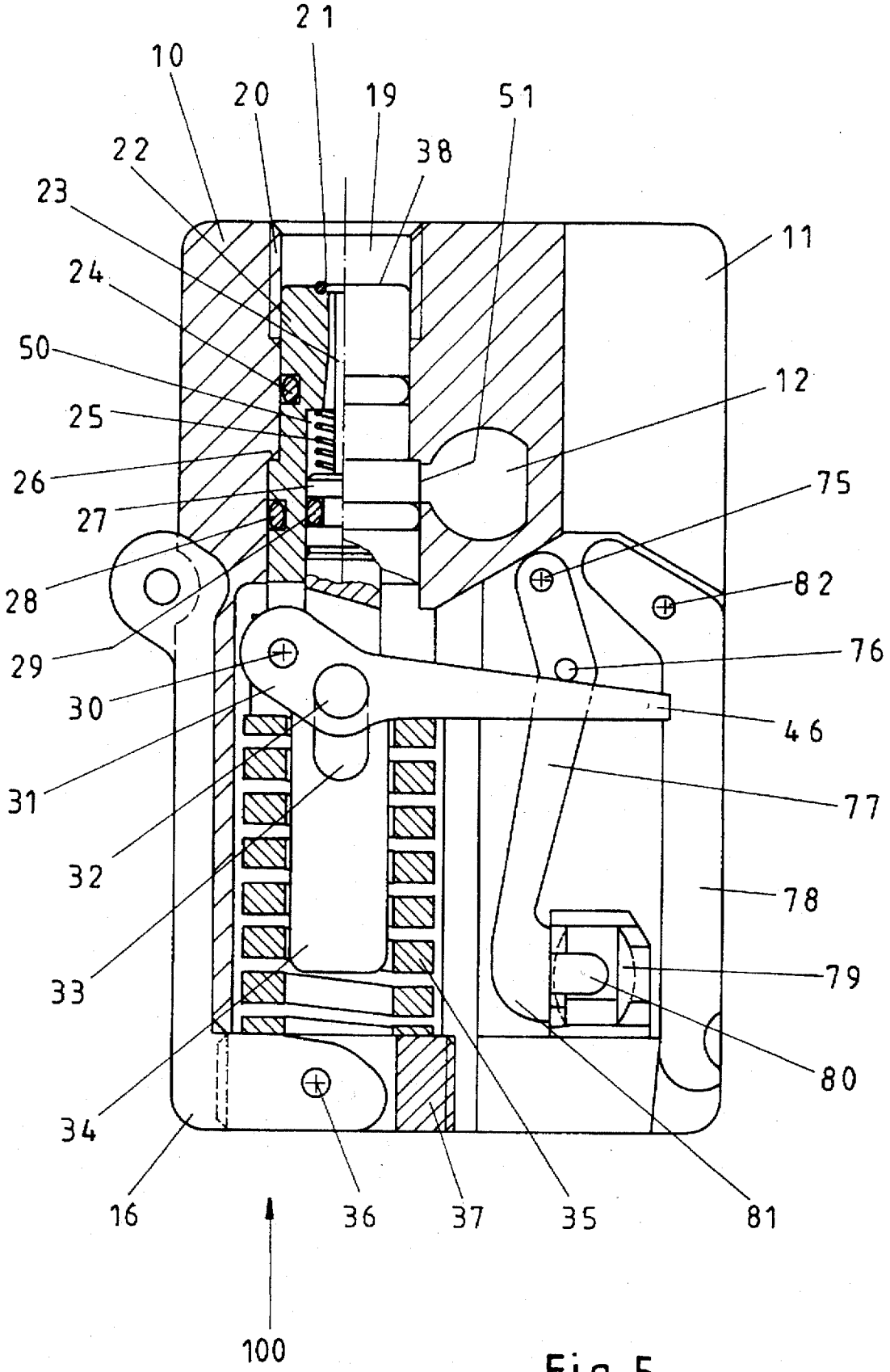
FIG. 5 shows, in a partial section, the inner structure of a fifth embodiment example of the inventive device allowing a release with the aid of a conventional water-soluble tablet.

A further embodiment example allowing an all-mechanical release is shown in FIG. 5. The opening mechanism is again identical to the mechanism of the examples shown in FIGS. 2 and 4. The releasing unit 11 with the locking lever 77 adapted to be pivoted about the pivoted axis 75, the locking bolt 76 and the covering portion 78 adapted to be pivoted about the pivoted axis 82 outwardly, in its structure, is comparable to FIG. 4. The electrically controllable locking pawl, however, here is replaced by a tablet 79 known per se, which tablet 79 is provided within a disposable supporting means and loses its solidity when getting into touch with water. The lever end 81 of the locking lever 77, after decomposition of the tablet 79, can pivot to the right so as to permit the release lever 31 to move upwardly for the purpose of release. A window 80 usefully is provided for controlling the condition of the tablet 79, through which window 80 one can have a look from outside at at least parts of the tablet 79.

Figure 6:
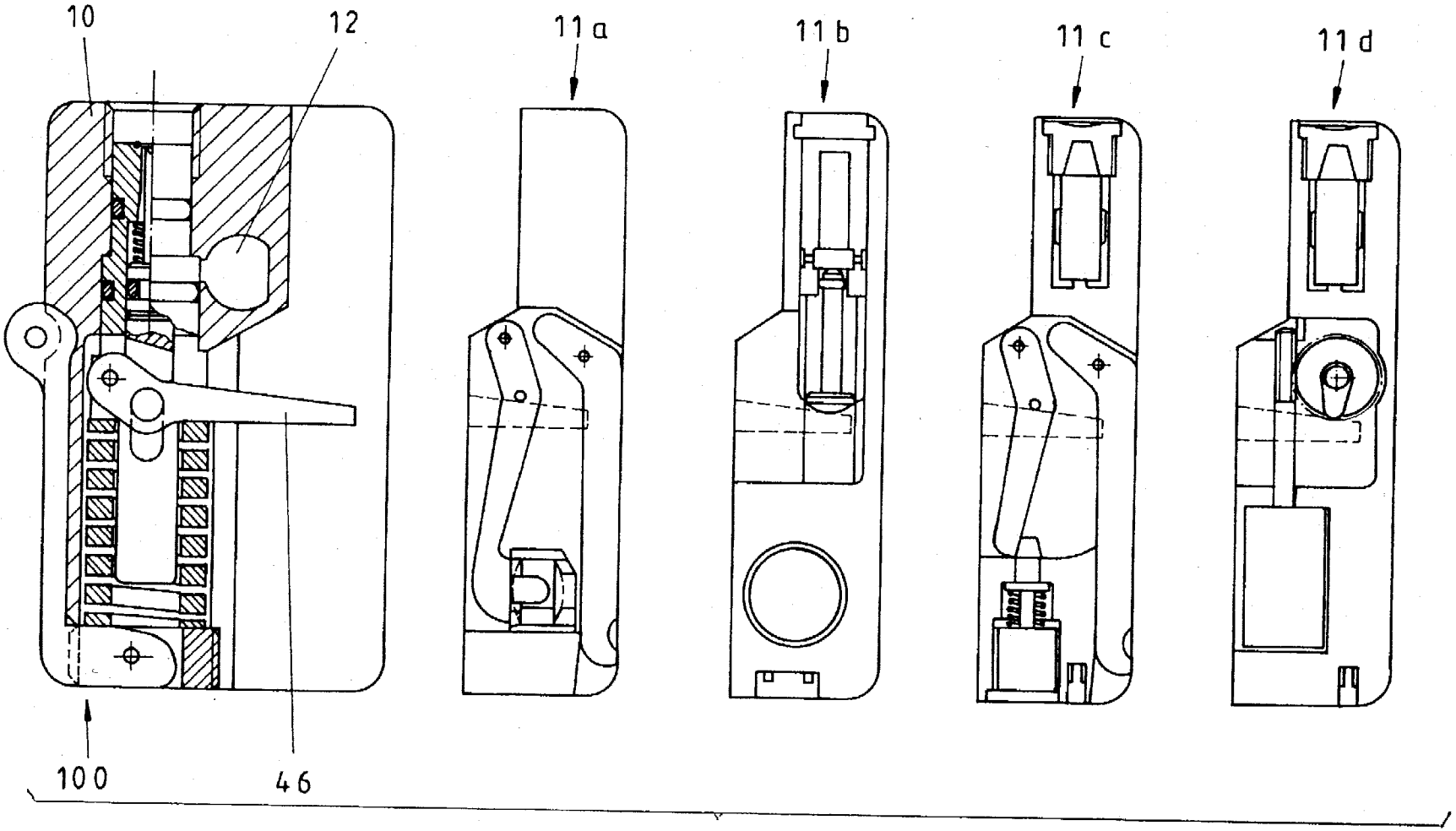
FIG. 6 shows, in a general view, the basic device appearing from FIGS. 2 to 5 which comprises the different replaceable releasing units according to FIGS. 2 to 5.

As already mentioned previously, the described various releasing units 11 can be combined with one and the same releasing mechanism provided in the housing 10. To demonstrate this flexibility FIG. 6 shows the different possibilities side by side again, 11*a* showing the release by the tablet according to FIG. 5, 11*b* showing the release by means of the locking plunger and the locking element according to FIG. 3, 11*c* showing the release by means of the electromagnetically controllable locking pawl, and 11*d* showing the release by means of the motor driven locking cam. This illustration directly shows that a basic body can be easily equipped with any type of the release unit 11*a–d* according to demand.

For the electrically controlled releasing units, embodiment examples of which are shown in FIGS. 2, 3 and 4, an electric release circuit is required which in response to the sensor 49, 60, 73 starts release.

Figure 7:
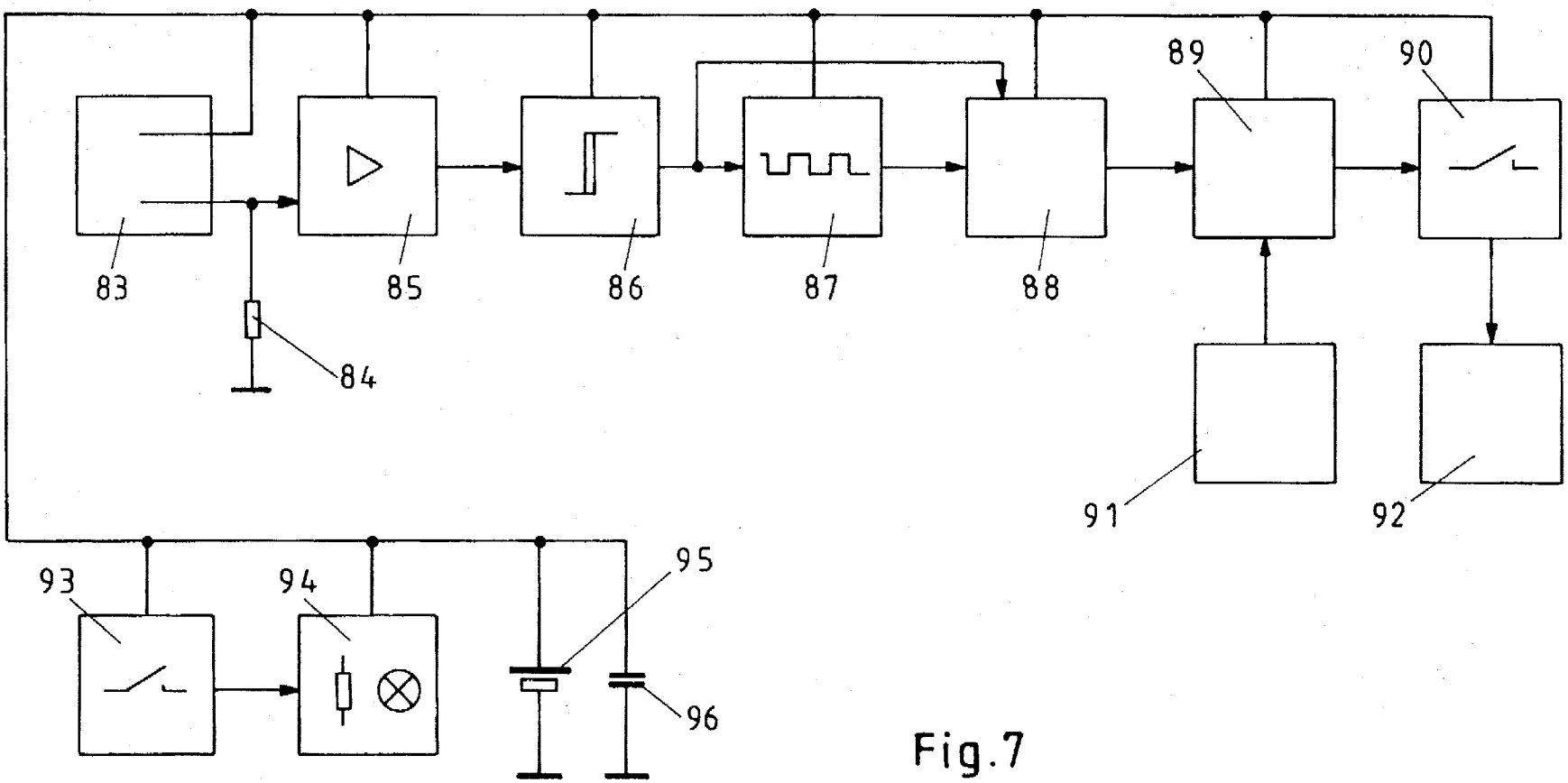
FIG. 7 shows an exemplary block diagram of an electric release circuit comprising a resistance sensor for the device according to the invention.

FIG. 7 shows an exemplary block diagram of an electric release circuit which at the input end comprises a resistance sensor and which to use for the inventive device proves beneficial. The sensor is a resistance sensor 83 which between two electrodes measures the resistance of the medium therebetween, which, in the case of release, is water. The resistance sensor 83 together with another resistance 84 forms a voltage divider. The voltage lost in this voltage divider 83, 84 is applied to the input of a threshold circuit 86 by means of an intermediate amplifier 85. The output signal of the threshold circuit 86 drives an oscillator 87, the oscillations or pulses of which are counted by a subsequently arranged counting means 88 which, by means of the output pulse of said threshold circuit 86, at the same time had been reset via the reset input. When having reached a predetermined counter indication, which can be detected by means of a subsequently arranged decoder 89, a release switch 90 is actuated for releasing the electrically controllable locking means which is shown as an actuator 92 here. The actuator may be the electric motor 48 of FIG. 2, the electrically destructible locking element 55 of FIG. 3, the electromagnet 74 of FIG. 4 or any comparable means. As a result of the combination of an oscillator and a counter, release can be made after a certain delay of time which is desirable for a safe operation. The time delay can be preset by means of a predetermining timecounter 91, with the aid of which the decoder 89 can be set to the corresponding counter indication. Electric energy is supplied to the circuit by means of a battery 95 which is connected in parallel to a buffer capacitor 96 for buffering any peak current. The operativeness of the battery 95 can be checked with the aid of a push-button 93 which temporarily activates a display circuit 94 for the battery voltage and battery capacity, respectively.

Figure 8:
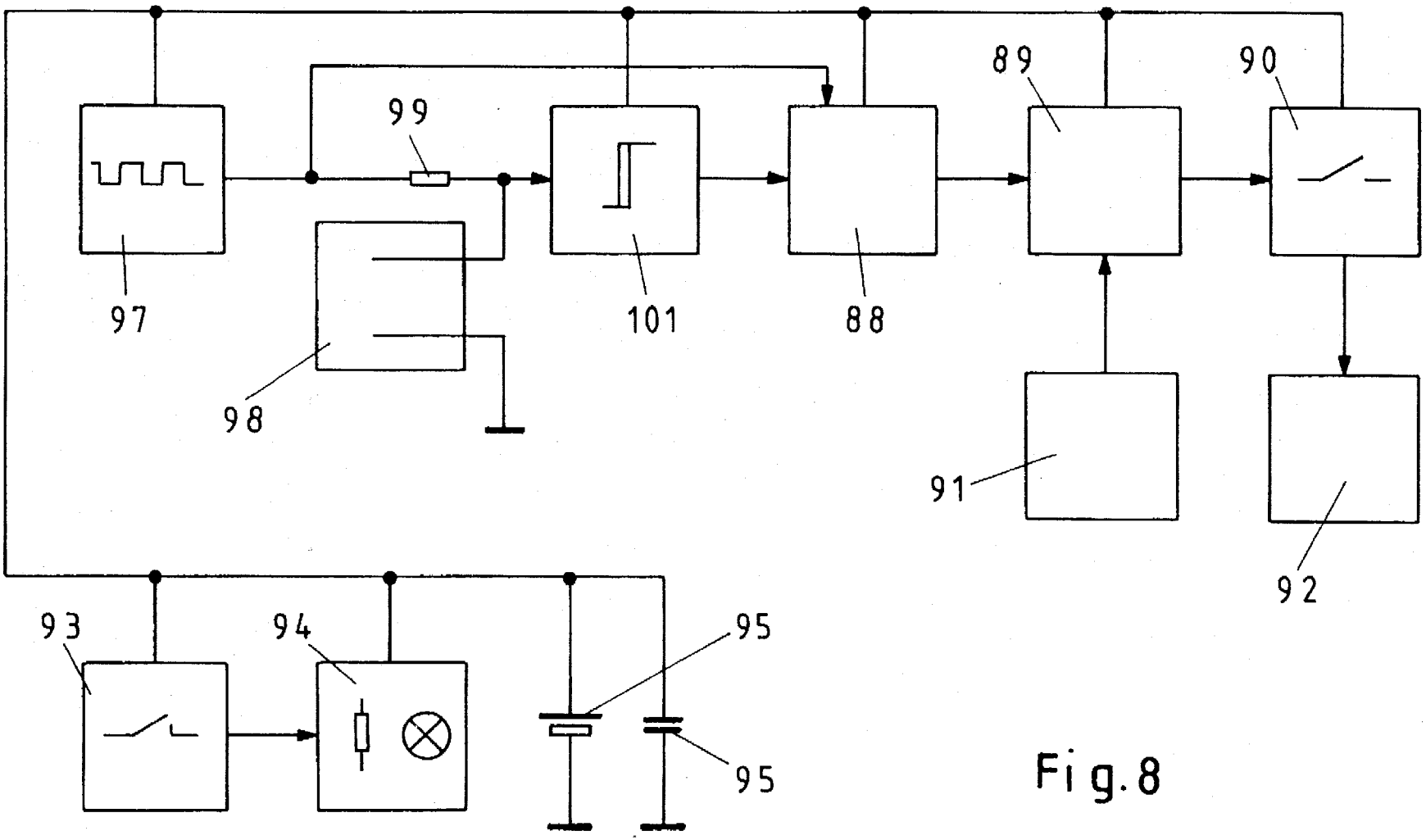
FIG. 8 shows a block diagram of a release circuit comparable to FIG. 7 which comprises a capacitive sensor.

FIG. 8 shows a block diagram of an exemplary electric release circuit comprising a capacitive sensor which block diagram is comparable to that of FIG. 7. With regard to the power supply 95, 96 and check 93, 94 of the same as well as the counting and actuating means 88–92, the circuit is identical to that of FIG. 7. The use of the capacitive sensor 98, however, makes another input wiring necessary. The capacitive sensor 98 together with a series resistance 99 forms a voltage divider. The voltage divider 98, 99 is connected to the output of an oscillator or pulse generator 97. The voltage pulses lost in said voltage divider 98, 99 are applied to the input of a threshold circuit 101. The counting means 88 already known is connected subsequent to said threshold circuit 101. The clock-input of the counting means 88 is connected to the output of the oscillator 97. The reset-input of the counting means 88 is connected to the output of the threshold circuit 101. The threshold circuit 101 is responsive to all pulses from the oscillator 97 as long as the capacity of the capacitive sensor 98 is low, and resets the counting means 88 to avoid a build-up of the counter indication. If, however, the capacity of the sensor 98 increases all of a sudden the threshold circuit 101 will not be responsive any longer, the reset pulses stop and the counting means 88 is capable of counting without hindrance the pulses received from the oscillator 97 at the clock-input until a preadjustable counter indication is reached—as described above—and the device released.

Figure 9:
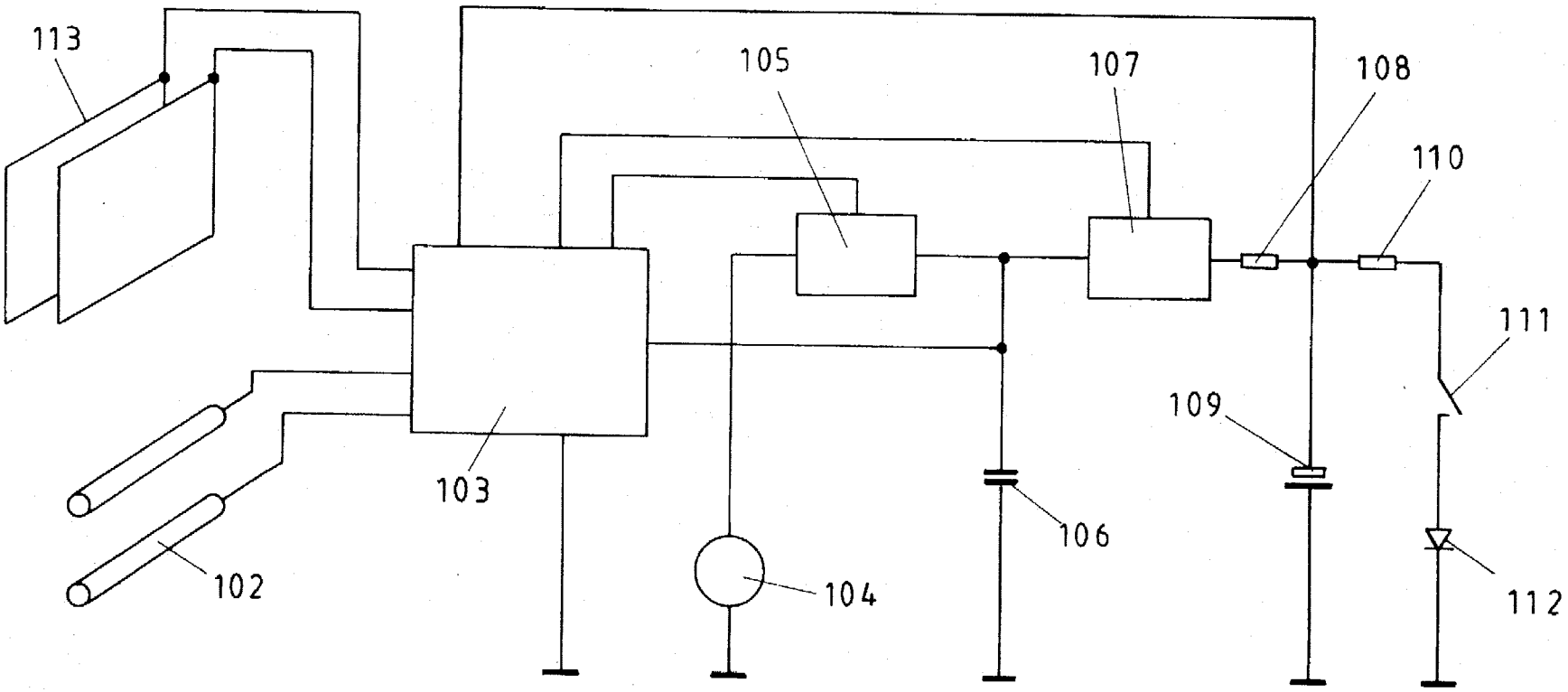
FIG. 9 shows the block diagram of an exemplary release circuit for the inventive device which comprises a combination of a resistance sensor and a capacitive sensor.

FIG. 9 finally shows the block diagram of an exemplary release circuit for the inventive device which comprises a combination of a resistance sensor 102 and a capacitive sensor 113. Both sensors 102 and i 13 are connected to two signal inputs of a control circuit 103. Said control circuit 103 first actuates a charging switch 107 and, thereafter, a release switch 105 as soon as the case of release is detected by one of the two sensors 102, 113, which procedure takes place as follows: In the state of rest, the two electronic switches 105 and 107 are opened. The battery 109 provided for the supply of energy thus is neither connected to a parallel switchable buffer capacitor 106 nor to an actuator 104. The energy reserve thereof, however, can be checked by temporarily connecting to the battery a lightemitting diode 112 via a series resistance 110 with the aid of a key 111. The light-emitting diode 112 lights up to signalize that there is sufficient energy reserve for ensuring a proper function.

In the case of release, which is detected by the control circuit 102, the (electronic) charging switch 107, first of all, is closed and the buffer capacitor 106 as an intermediate energy memory is charged via the charging resistance 108. Thereat the time constant for the charging procedure typically takes about 2 seconds. During the charging procedure, the voltage put on the buffer capacitor 106 is measured by the control circuit 103. As soon as the voltage has reached a level being sufficient for the ignition procedure, the (electronic) release switch 105 is closed and the charge stored in the buffer capacitor 106 is discharged through the actuator 104 which procedure causes the mechanism to release in the before described way. Detection can be made by measuring the ohmic resistance between the electrodes of the resistance sensor 102 as well as by additionally measuring a capacitance variation between the (plain) electrodes of the capacitive sensor 113. There, in this way, is not only achieved a redundancy with regard to the sensors but it is also ensured that the device will be always responsive to any different properties of the releasing medium (water) as well. The control circuit e.g. may be defined as an integrated circuit component and comprise a microprocessor or a customized circuit (ASIC).

All in all, the invention provides a flexibly employable and adaptable releasing and inflating device which, at the same time, features a reliable function and compact structure.

I claim:

1. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein said sensor is a resistance sensor and/or a capacitive sensor, wherein within said housing at the bottom end of said shifting member as a retaining element a single-armed releasing lever at one end is mounted pivotally across shifting direction of said shifting member and with one lever arm projects into said releasing unit, and wherein the electrically controllable locking means comprises a locking cam rotatably mounted on an axis, which locking cam acts upon said lever arm of said releasing lever and, with the aid of an electric motor, can be driven by gear consisting of a spur gear and a threaded worm.

2. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein said sensor is a resistance sensor and/or a capacitive sensor, wherein within said housing at the bottom end of said shifting member as a retaining element a single-armed releasing lever at one end is mounted pivotally across shifting direction of said shifting member and with one lever arm projects into said releasing unit, and wherein said electrically controllable locking means comprises a locking plunger which with a plunger head acts upon said lever arm of said releasing lever and with its other end is supported by an electrically destructible locking element.

3. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein said sensor is a resistance sensor and/or a capacitive sensor, wherein within said housing at the bottom end of said shifting member as a retaining element a single-armed releasing lever at one end is mounted pivotally across shifting direction of said shifting member and with one lever arm projects into said releasing unit, and wherein said electrically controllable locking means comprises a locking lever which, in the operative state of the device, with one lever end is supported by a locking pawl adapted to be withdrawn with the aid of an electromagnet to, in this way, hold said retaining element in its retaining position and, in the case of release, is pivoted about a pivoted axis for releasing said retaining element.

4. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein said pressure gas container can be screwed into the bore, with said spring being tensioned at the same time;

wherein said spring can be tensioned by means of a shifting member displaceably guided within said housing and acting upon said spring, and, while screwing in said pressure gas bottle from an initial position in the pretensioning direction of said spring, said shifting member is displaceable from said pressure gas container; and wherein at the bottom end of said shifting member as a retaining element a single-armed releasing lever at one end is mounted pivotally across shifting direction of said shifting member, said releasing lever with one lever arm projects into said releasing unit and is held there in the retaining position, and wherein said releasing lever with its lever arm acts upon said spring so that it tensions said spring when said shifting member is moved in while screwing in said pressure gas container and keeps said spring in its tensioned position while being held in its retaining position, and that said releasing lever acts upon said opening cutter in the direction of piercing.

5. The device according to claim 4, wherein said opening cutter is arranged on a central bolt displaceably provided within said housing, said opening cutter can be actuated manually through said central bolt with the aid of an operating arm mounted pivotally at the outside of said housing, and wherein said releasing lever with an operating bolt engages an elongated hole arranged within said central bolt.

6. The device according to any of the claims 4 or 5, wherein said releasing unit is defined as a separate releasing unit which can be connected to said housing so as to be replaceable with the same.

7. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein as a sensor a resistance sensor and a capacitive sensor are provided, said two sensors are connected to two inputs of a control circuit, and wherein said control circuit actuates a release switch as soon as one of said two sensors signalizes the necessity of causing release.

8. The device according to claim 7, wherein the energy for releasing said device is got from a battery, and that a battery check display is provided for checking the status of said battery.

9. The device according to claim 8, wherein a buffer capacitor is connected or connectable in parallel with said battery, which buffer capacitor is charged by said battery and, in the case of release, is discharged for activating said electrically controllable locking means.

10. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein said sensor is a capacitive sensor, said capacitive sensor together with a series resistance forms a voltage divider, said voltage divider is connected to the output of an oscillator, the voltage pulses lost in said voltage divider are applied to the input of a threshold circuit, said threshold circuit is connected to a counting means, the clock input of which is connected to the output of said oscillator and the reset input of which is connected to the output of said threshold circuit, and wherein a release switch is actuated for releasing said electrically controllable locking means.

11. The device according to claim 10, wherein for adjusting a selectable time delay a decoder is arranged at the output of said counting means, which decoder compares the counter reading of said counting means with a number entered into a preset time-counter and transmits to said release switch a releasing signal as soon as the counter reading has arrived at the number that had been entered.

12. The device according to claim 10, wherein the energy for releasing said device is got from a battery, and that a battery check display is provided for checking the status of said battery.

13. The device according to claim 12, wherein a buffer capacitor is connected or connectable in parallel with said battery, which buffer capacitor is charged by said battery and, in the case of release, is discharged for activating said electrically controllable locking means.

14. A device for inflating a container or a floating body, more particularly a life jacket, with the aid of a cartridge filled with pressure gas which possesses a neck being provided with an external thread and sealed with a diaphragm at the upper side, the device comprising:

a housing within which a bore having a corresponding internal thread for screwing in said pressure gas cartridge, and an opening cutter having a piercing portion for piercing the diaphragm of the pressure gas cartridge screwed in, said opening cutter being movable towards the diaphragm as a result of the force of a spring releasing the tension, which spring is held in a pretensioned position with the aid of a retaining element and is relieved when actuating said device by moving said retaining element; and a releasing unit for releasing the retaining unit, said releasing unit comprising first means responding to the presence of water, and second means which in response to said first means release said retaining element held in the retaining position, wherein said first means comprises a sensor which transmits an electric signal and said second means comprises an electrically controllable locking means which, in the operative state, keeps said retaining element in the retaining position and releases the same in the case of release;

wherein said sensor is a resistance sensor, said resistance sensor together with another resistance sensor forms a voltage divider, that the voltage lost in said voltage divider is applied to the input of a threshold circuit, that the output signal of said threshold circuit drives an oscillator, and wherein the oscillations of said oscillator are counted by a subsequent counting means in order to actuate a release switch for releasing said electrically controllable locking means as soon as a predetermined counter reading is reached.

15. The device according to claim 14, wherein for adjusting a selectable time delay a decoder is arranged at the output of said counting means, which decoder compares the counter reading of said counting means with a number entered into a preset time-counter and transmits to said release switch a releasing signal as soon as the counter reading has arrived at the number that had been entered.

16. The device according to claim 14, wherein the energy for releasing said device is got from a battery, and that a battery check display is provided for checking the status of said battery.

17. The device according to claim 16, wherein a buffer capacitor is connected or connectable in parallel with said battery, which buffer capacitor is charged by said battery and, in the case of release, is discharged for activating said electrically controllable locking means.

18. A device for inflating a container or a floating body, more particularly a life jacket, from a pressure gas container, which possesses a neck provided with an external thread and sealed with a diaphragm on the top side, which device comprises a housing, wherein a housing bore provided with a matching internal thread for screwing the pressure gas container in and an opening cutter having a prong for piercing the diagram of the screwed-in pressure gas container is disposed, in which the opening cutter is movable by means of the force of a spring whose tension is released against the diaphragm, which spring is retained in a pretensioned position with the aid of a retaining element and, when said device is rendered operative, is released by the retaining element being moved and which device comprises a triggering or actuating unit comprising first means responding to the presence of water, and second means which, in dependence of the first means, release the retaining element held in the retaining position, characterized in that the device is divided into two portions, one portion, into which the pressure gas bottle is screwed and which contains the mechanical means for piercing the diaphragm, and a second portion, the triggering means, which is replaceable, comprising first means which respond to the presence of water and second means which, in dependence of the first means, release the retaining element assuming the retaining position.

19. The device according to claim 18, characterized in that, in the triggering unit, the first means comprises a sensor which emits an electric signal and in that the second means comprises an electrically operable blocking means, which maintains the retaining element in an operationally ready state in the retaining position and releases the same when the device is actuated.

20. The device according to claim 18, characterized in that the pressure gas container can, while simultaneously pretensioning the spring, be screwed into the bore in the housing, which is connected to the replaceable triggering unit.

21. The device according to claim 20, characterized in that the device for piercing the diaphragm possesses a displacement part which, when the pressure gas container is screwed in, is displaceable from an initial position in the pretensioning direction of the spring, which is then tensioned, from the pressure gas container.

22. The device according to claim 21, characterized in that said spring can be tensioned by means of a shifting member displaceably guided within said housing and acting upon said spring, and that, while screwing in said pressure gas bottle from an initial position in the pretensioning direction of said spring, said shifting member is displaceable from said pressure gas container.

23. The device according to claim 22, characterized in that at the bottom end of said shifting member as a retaining element a single-armed releasing lever at one end is mounted pivotally across shifting direction of said shifting member, that said releasing lever with one lever arm projects into said releasing unit and is held there in the retaining position, that said releasing lever with its lever arm acts upon said spring so that it tensions said spring when said shifting member is moved in while screwing in said pressure gas container and keeps said spring in its tensioned position while being held in its retaining position, and that said releasing lever acts upon said opening cutter in the direction of piercing.

24. The device according to claim 18, characterized in that the triggering unit possesses a covering portion that can be swung open outwardly and which, in the swung-open state, makes the replacement or the servicing of the blocking means possible.

25. The device according to claim 24, characterized in that the blocking element in the triggering means has to be mechanically or electrically released with the aid of a sensor.

26. The device according to claim 25, characterized in that said releasing unit comprises a covering portion adapted to be pivoted outwardly which permits a tablet to be inserted while being pivoted outwardly.

27. The device according to claim 25, characterized in that said sensor is a resistance sensor and/or a capacitive sensor.

28. The device according to claim 25, characterized in that within said housing at the bottom end of said shifting member as a retaining element a single-armed releasing lever at one end is mounted pivotally across shifting direction of said shifting member and with one lever arm projects into said releasing unit, and that the electrically controllable locking means comprises a locking cam rotatably mounted on an axis, which locking cam acts upon said lever arm of said releasing lever and, with the aid of an electric motor, can be driven by gear consisting of a spur gear and a threaded worm.

29. The device according to claim 25, characterized in that within said housing at the bottom end of said shifting member as a retaining element a single-armed releasing lever at one end is mounted pivotally across shifting direction of said shifting member and with one lever arm projects into said releasing unit, and that said electrically controllable locking means comprises a locking plunger which with a plunger head acts upon said lever arm of said releasing lever and with its other end is supported by an electrically destructible locking element.

30. The device according to claim 25, characterized in that within said housing at the bottom end of said shifting member as a retaining element a single-armed releasing lever at one end is mounted pivotally across shifting direction of said shifting member and with one lever arm projects into said releasing unit, and that said electrically controllable locking means comprises a locking lever which, in the operative state of the device, with one lever end is supported by a locking pawl adapted to be withdrawn with the aid of an electromagnet to, in this way, hold said retaining element in its retaining position and, in the case of release, is pivoted about a pivoted axis for releasing said retaining element.

31. The device according to claim 25, characterized in that said sensor is a resistance sensor, that said resistance sensor together with another resistance sensor forms a voltage divider, that the voltage lost in said voltage divider is applied to the input of a threshold circuit, that the output signal of said threshold circuit drives an oscillator, and that the oscillations of said oscillator are counted by a subsequent counting means in order to actuate a release switch for releasing said electrically controllable locking means as soon as a predetermined counter reading is reached.

32. The device according to claim 25, characterized in that said sensor is a capacitive sensor, that said capacitive sensor together with a series resistance forms a voltage divider, said voltage divider is connected to the output of an oscillator, that the voltage pulses lost in said voltage divider are applied to the input of a threshold circuit, that said threshold circuit is connected to a counting means, the clock input of which is connected to the output of said oscillator and the reset input of which is connected to the output of said threshold circuit, and that a release switch is actuated for releasing said electrically controllable locking means.

33. The device according to claim 25, characterized in that as a sensor a resistance sensor and a capacitive sensor are provided, said two sensors are connected to two inputs of a control circuit, and that said control circuit actuates a release switch as soon as one of said two sensors signalizes the necessity of causing release.

34. The device according to any one of claims 31 or 32, characterized in that for adjusting a selectable time delay a decoder is arranged at the output of said counting means, which decoder compares the counter reading of said counting means with a number entered into a preset time-counter and transmits to said release switch a releasing signal as soon as the counter reading has arrived at the number that had been entered.

35. The device according to any one of claims 21 to 33, characterized in that the energy for releasing said device is got from a battery, and that a battery check display is provided for checking the status of said battery.

36. The device according to any one of claims 31 to 33, characterized in that a buffer capacitor is connected or connectable in parallel with said battery, which buffer capacitor is charged by said battery and, in the case of release, is discharged for activating said electrically controllable locking means.

* * * * *